US008016015B2

(12) United States Patent
Chamberlain et al.

(10) Patent No.: US 8,016,015 B2
(45) Date of Patent: Sep. 13, 2011

(54) GARAGE DOOR LOCK

(76) Inventors: Christopher Martin Chamberlain, Calgary (CA); Richard Barry Gorr, Calgary (CA)

( * ) Notice: Subject to any disclaimer, the term of this patent is extended or adjusted under 35 U.S.C. 154(b) by 932 days.

(21) Appl. No.: 11/349,019

(22) Filed: Feb. 7, 2006

(65) Prior Publication Data

US 2007/0181268 A1 Aug. 9, 2007

(51) Int. Cl.
*E05D 15/00* (2006.01)
*A47H 7/00* (2006.01)

(52) U.S. Cl. ..... 160/201; 160/405

(58) Field of Classification Search ..... 16/97, 99; 160/201, 207, 236; 292/92, DIG. 36, DIG. 6, 292/DIG. 78, DIG. 79; 70/1, 14, 18, 27, 70/32, 34, 38 C, 53, 77, 177, 180, 200, 211, 70/212, 203, DIG. 11
See application file for complete search history.

(56) References Cited

U.S. PATENT DOCUMENTS

| | | | | |
|---|---|---|---|---|
| 3,822,573 | A * | 7/1974 | Meyers | 70/200 |
| 3,953,062 | A | 4/1976 | Maston | |
| 4,031,719 | A | 6/1977 | Klingler et al. | |
| 4,443,033 | A | 4/1984 | D'Anna | |
| 4,480,863 | A * | 11/1984 | Hormann | 292/216 |
| 4,580,423 | A | 4/1986 | Craig | |
| 4,613,175 | A | 9/1986 | Nelson | |
| 4,659,121 | A | 4/1987 | McGee | |
| 4,668,899 | A | 5/1987 | Ide et al. | |
| 4,819,379 | A | 4/1989 | Kenzelmann et al. | |
| 4,861,079 | A | 8/1989 | DeForrest, Jr. | |
| 4,911,486 | A | 3/1990 | Anderson | |
| 5,458,383 | A | 10/1995 | Gunn | |
| 5,475,995 | A * | 12/1995 | Livingston | 70/259 |
| 5,547,236 | A | 8/1996 | Gregory | |
| D391,469 | S * | 3/1998 | Foushee | D8/346 |
| 6,367,292 | B1 * | 4/2002 | Bunger | 70/56 |
| 6,668,601 | B1 | 12/2003 | Reddick | |
| 6,719,334 | B1 | 4/2004 | Curtis | |
| 6,915,670 | B2 | 7/2005 | Gogel | |
| D562,110 | S * | 2/2008 | Garcia | D8/343 |
| 2002/0011734 | A1 * | 1/2002 | Pickett | 292/319 |
| 2005/0251958 | A1 * | 11/2005 | Coblentz et al. | 16/97 |

* cited by examiner

*Primary Examiner* — Katherine Mitchell
*Assistant Examiner* — Jeremy Ramsey
(74) *Attorney, Agent, or Firm* — W. Allen Marcontell

(57) ABSTRACT

An overhead opening door lock device for use with existing types of door systems having horizontally hinged panels carried on rollers confined within channeled roller tracks is attached on the interior side of the door and fixes the door in position relative to the roller track. One leg of a U-shaped device is inserted in the hollow interior of a tube that serves as an articulation axis for a pair of hinged panels. The other leg of the U-shaped device penetrates a suitably positioned aperture in the web of the adjacent channeled roller track. A shear pin or padlock shank may be inserted through an aperture in a tip portion of the other leg that projects past the outside plane of the roller track web.

8 Claims, 3 Drawing Sheets

GARAGE DOOR LOCK

BACKGROUND OF THE INVENTION

1. Field of the Invention

The present invention relates to a method and mechanical locking device suitable for securing the closure position of an overhead door having hinged panels carried on rollers that are guided along a pair of channeled roller tracks.

2. Description of Related Art

Portal closures such as overhead opening doors of the type typically used for residential garages and commercial vehicle stalls generally comprise a plurality of horizontal panels that are hinged together along adjacent panel edges for articulation about parallel axes. Each panel is supported at opposite horizontal ends by rollers confined within a channeled track.

Numerous locking appliances for overhead opening doors of the type described rely on direct or indirect radio-controlled electrical or electronic actuation and are subject to compromise with sophisticated radio communication methods. U.S. Pat. Nos. 4,668,899 and 4,819,379 provide examples of this category of locking systems. Mechanical locks having manually sliding deadbolts that may be emplaced on the interior of the overhead door are also available in many designs. U.S. Pat. Nos. 4,031,719 and 5,458,383 describe mechanical locks suitable for the exterior side of overhead garage doors.

A suitable mechanical locking appliance designed for use with a traditional padlock and for placement on the interior side of the door has not been available heretofore. Such a device would be immune to those methods employed to defeat electrically or electronically actuated locks. Emplacement of the lock on the interior side of the door would protect the lock from physical tampering and compromise—the invader would have to break and enter the building via another entryway before he could attack such a garage door lock.

A type of locking appliance that takes advantage of mechanical design features that are widely used in overhead door systems is desirable. Further to this, it is desirable that such a locking device should require only minimum mechanical installation preparation and be suitable for widely used overhead door systems. A locking device that relies on commonly available padlocks combined with a unique, robust and easy-to-use mechanical appliance is also desirable. Finally, the locking device should be simple and easy-to-manufacture and thus available at relatively low cost.

SUMMARY OF THE INVENTION

A preferred embodiment of the present invention which overcomes the limitations of prior overhead door locking systems features two unequal-length arms linked in a U configuration as an integral unit by a bight section. The first, shorter, arm is inserted axially within a rotation tube that serves as a hinge joint between two overhead door panels. The second, longer, arm is inserted through a suitably positioned aperture in the web of the roller track that carries the door.

The locking device is equipped with a tip on the second arm that protrudes through the aperture in the roller track web of the overhead door, away from the door. The second arm tip features an aperture through which a padlock may be reversibly secured. An intermediate length portion of the second arm may have a section between the tip and the bight section having a larger diameter than the rest of the arm to provide additional structural strength to deter mechanical attacks. The locking device may be constructed of stainless steel or other material of suitable strength and hardness, either metallic or non-metallic.

The preferred embodiment provides a higher level of security than normally available in prior art systems because the lock is simply emplaced on the interior side of the door without requirement of special preparations—other than to drill a hole in the roller track web in any and all suitable positions at which a secure door position is desired. The lock cannot be defeated by electromagnetic or electro-mechanical means.

BRIEF DESCRIPTION OF THE DRAWINGS

Other features and advantages of the invention will be recognized and understood by those of skill in the art from reading the following description of the preferred embodiments and referring to the accompanying drawings wherein like reference characters designate like or similar elements throughout the several figures of the drawings and wherein.

DESCRIPTION OF THE PREFERRED EMBODIMENTS

Figure 1:
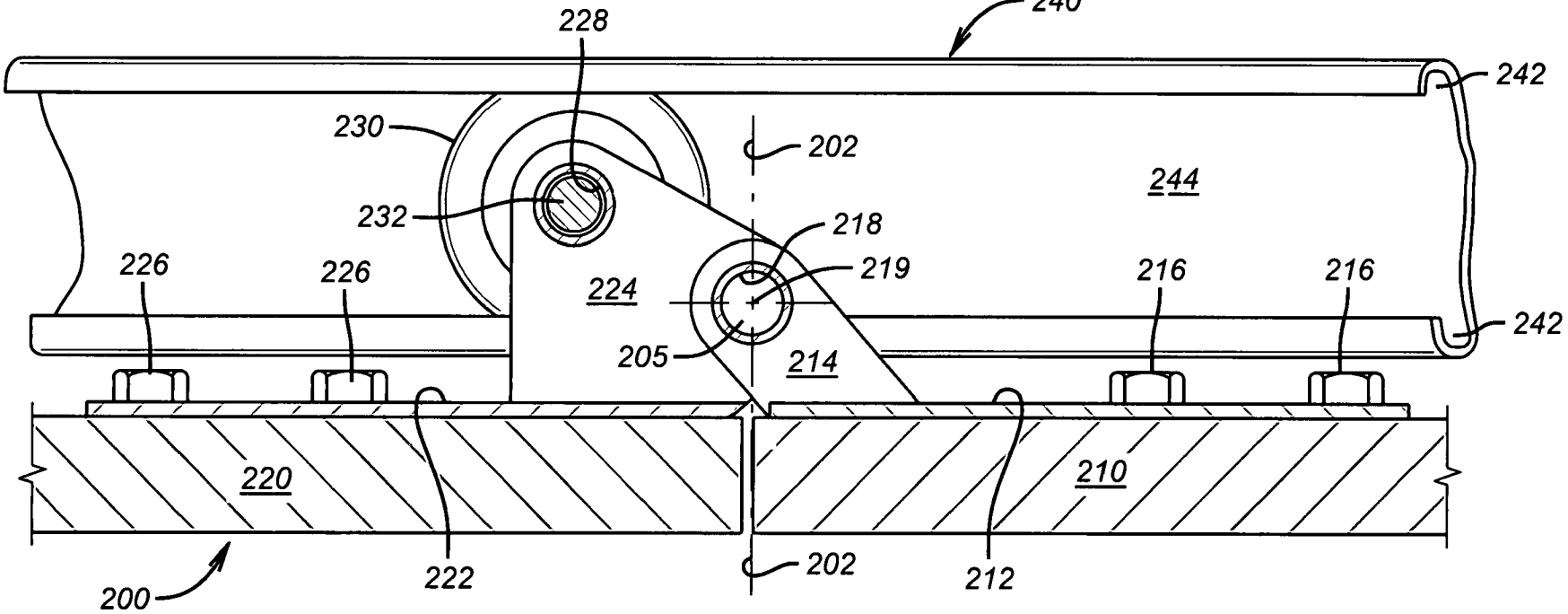
(PRIOR ART) FIG. 1
FIG. 1 is a partially sectioned elevation view of a prior art overhead door showing the panel hinge and roller and track assembly.

FIG. 1 is a partially sectioned end view of a prior art overhead door and roller track assembly 200 showing two adjacent, horizontally aligned door panels 210 and 220. One panel 210 may be designated the "upper" panel relative to a vertical panel alignment, for example. The adjacent panel 220 may be designated as the "lower" panel. At opposite distal ends of the horizontal panels are respective carrier brackets. A roller bracket 222 is secured to the lower panel 220 by cap screws 226. Normally upstanding from the bracket 222 base plane are a pair of roller carrier plates 224. Bridging a space between the two roller carrier plates 224 is a roller axle confinement tube 228 and a hinge axis tube 218. The axis 219 of the hinge axis tube is usually positioned within an extension of the edge juncture plane 202 common to the adjacent panel edges.

A hinge bracket 212 is secured to the opposite distal ends of the upper panel 210 by cap screws 216. Normally upstanding from the hinge bracket base plane are a pair of hinge carrier plates 214. The hinge axis tube 218 passes through the carrier plates 214 to secure rotation of the carrier plates 214, and hence, hinge bracket 212 about the hinge axis 219. Notably, the hinge axis tube 218 comprises an annular wall around an axial hollow space 205.

A roller wheel 230 is secured to an outside end of the axle 232. The axle 232 is usually inserted loosely within the axial bore space formed within the tubular wall of the axial confinement tube 228 to permit limited axial displacement of the axle 232 relative to the confinement tube 228. The wheel 232 rotational plane is normally perpendicular to the axle 232 axis. Wheel 230 rolling alignment is confined between and along two channels 242 of a roller track 240. The track channels 242 are secured in constant, parallel alignment by the roller track web 244.

Figure 2:
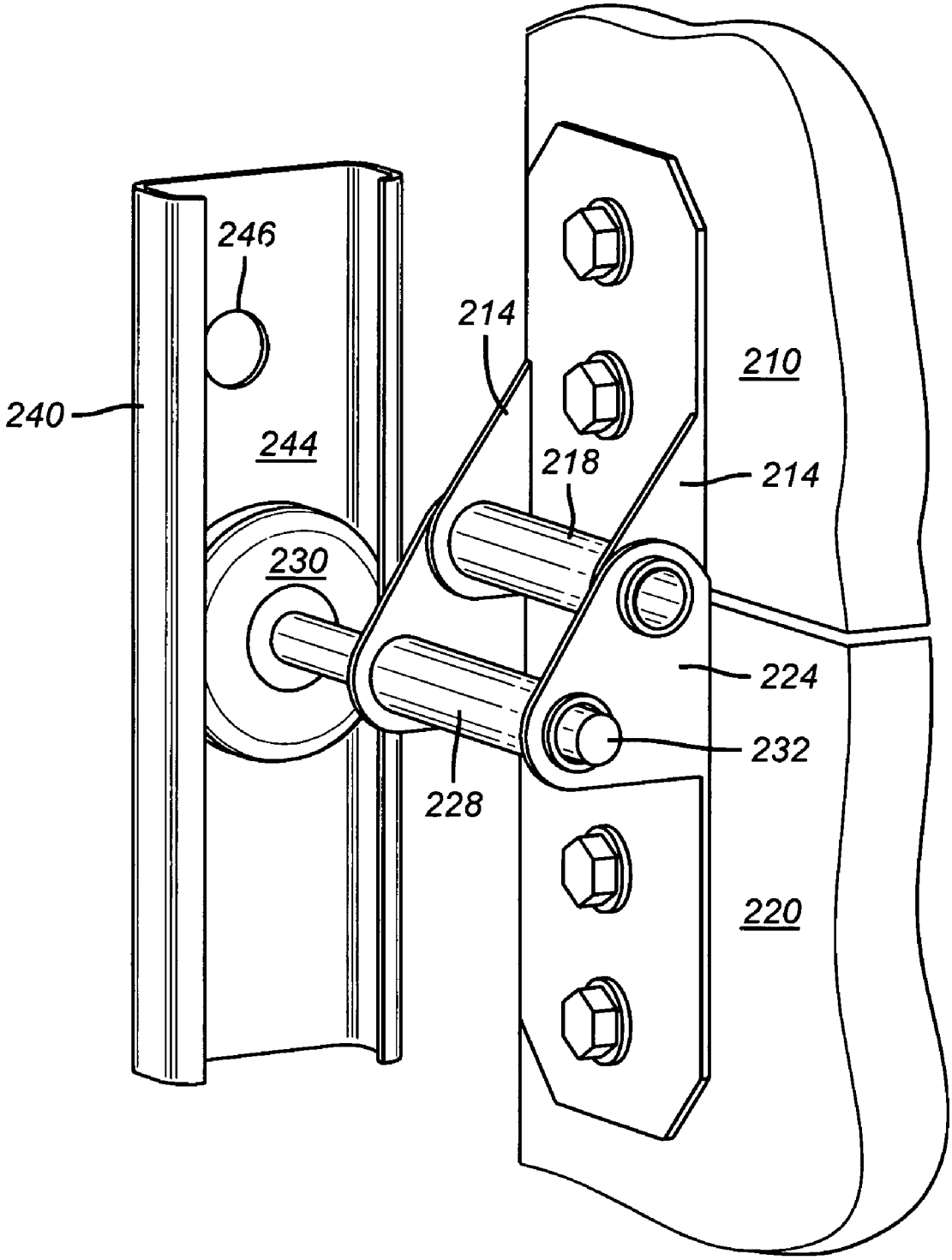
(PRIOR ART) FIG. 2
FIG. 2 is a pictorial view of the panel hinge and roller track assembly with the track web drilled to receive the present locking device

The prior art overhead door assembly of FIG. 1 is modified to practice the present invention in the manner illustrated by FIG. 2 which differentially shows an aperture 246 through the roller track web 244. The web 244 may be perforated by a multiplicity of apertures 246 at locations along the track 2 length corresponding to predetermined holding positions of the door when the locking device of the present invention is engaged.

Figure 3:
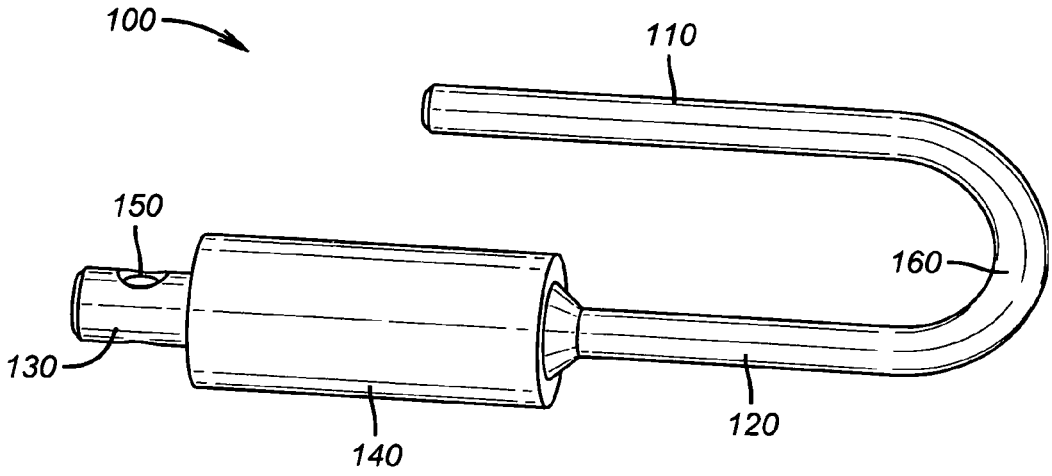
FIG. 3 is a schematic profile view of the overhead door locking device; and, FIG. 4 is a view of the interior margin of the overhead door and roller track assembly with the locking device and padlock emplaced.
Figure 4:
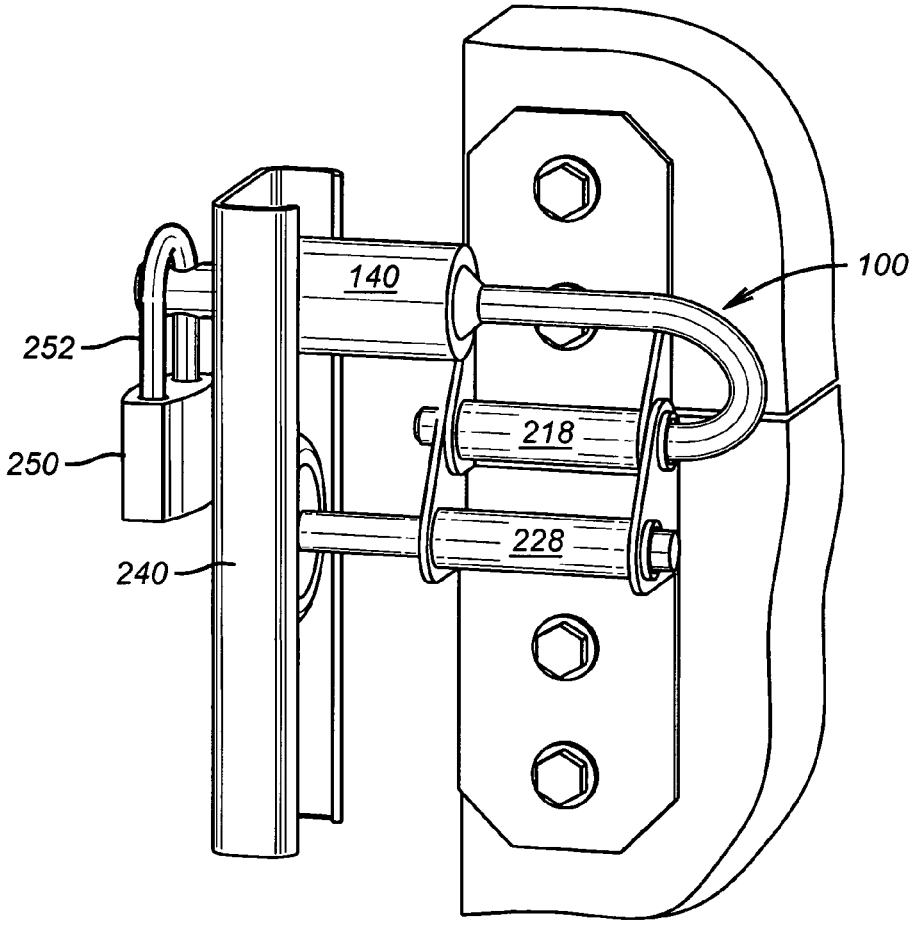

Referring to FIG. 3, a U-shaped locking device 100 is shown in schematic profile view. The locking device is designed for emplacement on the interior side of an overhead door assembly as typically utilized for vehicle garages in or in proximity to homes. The U-shaped locking device 100 has a first arm 110, a second arm 120 and a bight portion 160 that links the first and second arms. The first arm 110 is shorter than the second arm 120. The second arm 120 preferably has an enlarged section 140 with a significantly greater cross-sectional area than the remainder of the arm. The enlarged section 140 preferably bridges the joint between the lateral edges of the garage door and the adjacent door jams where, in some structures, a saw may be inserted in an attempt to sever the second arm 120. Alternatively, the enlarged section 140 may be given or replaced by a suitable hard-face treatment such as with carbide, titanium or diamond chips The two arms and linking bight member are preferably constructed with circular cross-section although other appropriately dimensioned cross-sectional geometries may be substituted such as squares, hexagons or octagons. The tip 130 of the second arm 120 extends beyond the end of the enlarged section 140 and may have a cross-sectional that is preferably intermediate between the diameters of the enlarged section 140 of the second arm and the bight portion 160. A tip-hole 150 penetrates through the tip 130 and is also preferably circular in cross-section. The tip-hole 150 is given a sufficient inside diameter to receive a standard lock shank 252 (FIG. 4).

Suitable dimensions for the locking device 100 are coordinated with dimensions of the overhead door and its roller track and associated components. One dimensional criterion is a coordination of the first arm 110 outside dimension to the inside dimension of the hinge axis hollow space 205 for an easily nested sliding fit of the first arm 110 inside of the hollow hinge axis tube 218. Another dimensional criterion is a coordination of the second arm tip section 130 outside dimension to the inside dimension of the web aperture 246 for a effortless penetration of the aperture by the tip section 130.

Typically, an overall length of approximately 5.75 inches, a cross-sectional diameter of 0.25 inches for the arms 110 and 120, a cross-sectional diameter of 1.0 inches for the enlarged section 140, and a cross-sectional diameter of 0.625 inches for the tip of the second arm 150 are suitable dimensions.

The locking device 100 may be constructed of 304 stainless steel or equivalent. Because of its simplicity of form and small size, the locking device is easy and economical to manufacture. It may be manufactured from component pieces or as a single piece but in the former case the component pieces will be permanently bonded together to form an effective single piece. Alternatively to 304 stainless steel, a different material of suitable strength and hardness, either metallic or non-metallic, may be used. Suitable strength and hardness are defined as of sufficient strength and hardness to successfully resist deformation or breakage of the locking device, from either outside or inside of the locked overhead door, by a determined predatory adult not equipped with specialized tools for the purpose.

FIG. 4 shows the present invention locking device 100 as positioned for locking an overhead door from translational movement along the roller track 240 thereby preventing movement of all depicted elements of the interior margin of the overhead door and roller track assembly 200. The installation procedure begins by inserting the first arm 110 into the hollow interior 205 of the hinge axis tube assembly 218 as he simultaneously inserts the tip 130 of the second arm 120 through a selected web aperture 246 in the roller track web 244. The user then secures the locking device 100 by inserting a shear pin or the shank 252 of an open padlock 250 through the tip-hole 150 and closed.

Unlocking is accomplished simply by the reverse process. Thus the locking device is simple and easy to use, both in the locking and in the unlocking process.

The position of the locked door is determined directly by the position of the aperture 246 in the roller track web 244. Consequently, the user must place this hole correctly to achieve the desired door position when locked. Normally this would be the fully closed position. If he wishes a slightly raised position for purposes such as pet access he may position the circular hole slightly higher in the roller track. Multiple holes may be prepared for multiple locked positions. The hole may be easily drilled with an electric drill and appropriate drill bits, available to the average homeowner.

Because the locking device 100 and padlock 250 are not accessible or even viewable except from the interior of the garage (or other enclosure) an illicit entry is better prevented than with exterior mechanical locking devices. No electromagnetic or electrical methods are capable of defeating the lock.

For the intruder, entering the garage by another entry way is necessary before he can attack the locking device 100 and padlock 250. For the illicit intruder this should require breaking before entering (if other entryways are appropriately secured).

For the user, the garage also must be accessible by another entryway to allow access to the locking device 100 for installation and removal. This requirement is met by the vast majority of home garages. The user may wish to employ the locking device 100 together with other prior-art locking devices for increased security. For an increased measure of security the user may elect to utilize two locking devices 100—one on each of the two roller tracks of the overhead door. Although the locking device 100 may be secured from external invasion by a simple shear pin through the tip-hole 150, an intruder who enters the structure interior by an alternative route may easily remove a shear pin and open the overhead door. For this reason, use of a padlock 250 is preferred.

The invention has been described for overhead garage doors; however it may also be utilized with any overhead door having the essential features of rotating panels and roller tracks, providing there is suitable alternative access to the interior of the structure, other than via the entry protected by the overhead door, as required for operating the locking device.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

The invention claimed is:

1. A method of securing the position of a portal closure comprising a plurality of parallel panels supported by rollers that are confined to translation along track channels that are separated by a track web, said panels being secured to hollow axle tubes for articulation about a substantially horizontal axis and said track web having at least one transverse aperture, said method comprising the steps of:

providing a substantially integral, U-shaped appliance having first and second, substantially parallel, arms linked by a bight section, said second arm being of greater length than said first arm and said first arm having a cross-sectional configuration for penetrating a hollow interior of said closure axle tube, a distal end portion of said second arm having a cross-sectional configuration for penetration of said track web aperture; and, simultaneously inserting said first arm of said U-shaped appliance into the hollow interior of said closure axle tube while inserting a distal end of said second arm through said track web aperture.

2. A method as described by claim 1 wherein a transverse aperture is provided through the distal end of said second arm for receiving a shear pin to prevent the withdrawal of said distal end from said web aperture.

3. A method as described by claim 1 wherein a transverse aperture is provided through the distal end of said second arm for receiving a padlock shank to prevent the withdrawal of said distal end from said web aperture.

4. A method as described by claim 1 wherein an intermediate length portion of said second arm between said bight section and said distal end is treated with a hard facing material.

5. A method as described by claim 1 wherein an intermediate length portion of said second arm between said bight section and said distal end has a greater cross-sectional area than said distal end.

6. The combination of a removable portal cover and an appliance to inhibit translation of said cover, said portal cover comprising a plurality of parallel panels supported by rollers that are confined to translation along track channels that are separated by a track web, said panels being secured to hollow axle tubes for articulation about a substantially horizontal axis, said track web having at least one transverse aperture; said appliance comprising a substantially integral, U-shaped member having first and second, substantially parallel arms linked by a bight section, said second arm being of greater length than said first arm and said first arm having a cross-sectional configuration for penetrating a hollow interior of said hollow axle tube, a distal end portion of said second arm having a cross-sectional configuration for penetration of said web aperture; said appliance being combined with said portal cover by the simultaneous presence of said first arm within the hollow interior of said hollow axle tube and of said second arm distal end portion within said web aperture whereby translation of said panels and rollers along said track is restrained.

7. A combination as described by claim 6 wherein an intermediate portion of said second arm between said distal end portion and said bight section has a greater cross-sectional area than that of said distal end portion.

8. A combination as described by claim 6 wherein an intermediate portion of said second arm between said distal end portion and said bight section carries a hard-facing material.

* * * * *